US010974947B1

(12) United States Patent
Qiao

(10) Patent No.: US 10,974,947 B1
(45) Date of Patent: Apr. 13, 2021

(54) LIQUID STORAGE APPARATUS

(71) Applicant: INTRADIN (SHANGHAI) MACHINERY CO., LTD., Shanghai (CN)

(72) Inventor: Xuetao Qiao, Shanghai (CN)

(73) Assignee: INTRADIN (SHANGHAI) MACHINERY CO., LTD., Shanghai (CN)

( * ) Notice: Subject to any disclaimer, the term of this patent is extended or adjusted under 35 U.S.C. 154(b) by 0 days.

(21) Appl. No.: 16/696,912

(22) Filed: Nov. 26, 2019

(30) Foreign Application Priority Data

Sep. 30, 2019 (CN) ..... 201921691628.5

(51) Int. Cl.
*B67D 1/12* (2006.01)
*B67D 1/08* (2006.01)
*B67D 1/00* (2006.01)

(52) U.S. Cl.
CPC ..... *B67D 1/1252* (2013.01); *B67D 1/0801* (2013.01); *B67D 2001/0098* (2013.01); *B67D 2001/0822* (2013.01)

(58) Field of Classification Search
CPC ..... B67D 1/1252; B67D 1/0801; B67D 2001/0098; B67D 2001/0822
USPC ..... 222/399
See application file for complete search history.

(56) References Cited

U.S. PATENT DOCUMENTS

| | | | | |
|---|---|---|---|---|
| 2,705,578 | A * | 4/1955 | Burns | F16K 13/04 141/17 |
| 3,679,104 | A * | 7/1972 | Giroud | B67D 1/0418 222/396 |
| 5,329,975 | A * | 7/1994 | Heitel | B65D 83/42 141/19 |
| 5,443,186 | A * | 8/1995 | Grill | B67D 1/0418 222/396 |
| 6,651,852 | B2 * | 11/2003 | Arellano | B67D 1/0418 222/399 |
| 8,070,023 | B2 * | 12/2011 | Vitantonio | B67D 1/1252 222/399 |
| 8,191,740 | B2 * | 6/2012 | Hoss | B67D 1/0418 222/399 |
| 9,352,949 | B2 | 5/2016 | Rege et al. | |
| 9,533,865 | B2 | 1/2017 | Sonnichsen et al. | |
| 2015/0336785 | A1 * | 11/2015 | Rege | B67D 1/1477 222/1 |

FOREIGN PATENT DOCUMENTS

CN 101208255 B 3/2013

* cited by examiner

*Primary Examiner* — Vishal Pancholi

(57) ABSTRACT

A liquid storage apparatus including a container, an upper cover, a dispensing faucet, a conduit, a gas cylinder and a gas cylinder sleeve. The container includes a cavity and an upper opening. The upper cover is arranged on the upper opening. The dispensing faucet is led out from a side of the upper cover and is connected to the conduit in the upper cover; and the conduit extends to a bottom of the container. The upper cover includes an adjusting knob, and a pressure of the cavity of the container is adjusted by rotating to open or close a valve of the gas cylinder. The pressure in the container can be adjusted since the gas cylinder is arranged in the container and the valve of the gas cylinder can be opened or closed by rotating the adjustment knob.

4 Claims, 9 Drawing Sheets

LIQUID STORAGE APPARATUS

CROSS-REFERENCE TO RELATED APPLICATIONS

This application claims the benefit of priority from Chinese Utility Model Application No. 201921691628.5, filed on Sep. 30, 2019. The content of the aforementioned application, including any intervening amendments thereto, is incorporated herein by reference in its entirety.

TECHNICAL FIELD

The present invention relates to storage tanks, more particularly, to a liquid storage apparatus.

BACKGROUND OF THE INVENTION

Beverages, such as beers, strong ciders and some wines, may contain dissolved carbon dioxide and/or other gases, which enables the beverages to be carbonated or bubbly. The dissolved gas may escape from the solution, causing the beverages go flat. Specifically, the beverages tend to go flat when the beverages are exposed to the atmospheric pressure. The beverages that went flat are not welcomed by the consumers.

The change of the pressure in a liquid container, affected by the external environment, will affect the change of the pressure of the carbon dioxide in the container. Therefore, the liquid container is required to be able to adjust the pressure in the container.

SUMMARY OF THE INVENTION

A liquid storage apparatus is in need to adjust the pressure in the liquid storage apparatus.

In order to achieve above purpose, the present invention provides a liquid storage apparatus, comprising: a container, an upper cover, a dispensing faucet, a conduit, a gas cylinder and a gas cylinder sleeve; wherein the container comprises a cavity and an upper opening;

the upper cover is arranged on the upper opening; the dispensing faucet is led out from a side of the upper cover and is connected to the conduit in the upper cavity; and the conduit extends to a bottom of the container; and the upper cover comprises an adjusting knob which adjusts a pressure in the cavity of the container by rotating to open or close a valve of the gas cylinder.

In some embodiments, the gas cylinder sleeve comprises an end portion and a sleeve body; the end portion is fixed to the upper cover.

In some embodiments, the upper cover further comprises a housing and a mounting portion arranged inside the housing.

In some embodiments, a plurality of holes are provided on the housing.

In some embodiments, the adjusting knob is arranged on a side of the mounting portion; the upper cover further comprises a pressure gauge which is fixed to a top surface of the mounting portion.

In some embodiments, along a direction from the adjusting knob to an inside of the mounting portion, the upper cover further comprises a first fixing nut, a torsion bar, a first spring, a push block, a second fixing nut, a sealing piece, a push rod, a guiding column, a sealing member, a slider, a second spring, a valve stem, a third spring and a third fixing nut;

where the torsion bar is connected to the adjusting knob passing through the first fixing nut; the sealing piece is arranged between the second fixing nut and the push rod; a lower portion of the push block abuts the sealing piece passing through a central hole of the second fixing nut; the push rod passes through the guiding column, and an upper portion of the push rod contacts the sealing piece and a lower portion of the push rod contacts the slider; the sealing member is pressed into an inner groove of the slider and contacts a lower portion of the guiding column; and the second spring abuts the slider.

In some embodiments, the upper cover further comprises a fixture and a connecting portion; the fixture is arranged on a side of the upper cover facing the cavity; the connecting portion is connected to the fixture; and the upper cover is connected to the gas cylinder via the connecting portion.

In some embodiments, the connecting portion is the third fixing nut and is screwed to the gas cylinder sleeve.

The liquid storage apparatus provided by the present invention comprises the container, the upper cover, the dispensing faucet, the conduit, the gas cylinder and the gas cylinder sleeve; the container comprises the cavity and the upper opening; the upper cover is arranged on the upper opening; the dispensing faucet is led out from the side of the upper cover and is connected to the conduit in the upper cover; and the conduit extends to the bottom of the container; and the upper cover comprises the adjusting knob which adjusts the pressure of the cavity of the container by rotating to open or close the valve of the gas cylinder. The pressure in the container can be adjusted since the gas cylinder is arranged in the container and the valve of the gas cylinder can be opened or closed by the rotating of the adjustment knob, such that the amount of gas can be adjusted according to the personal preference to have different textures, where the gas is not limited to $CO_2$ and could be $N_2$; and since the dispensing faucet is led out from the side of the upper cover, the liquid can be more easily dispensed. The liquid storage apparatus in the present invention has the advantages of small size, integrated functions and cost saving.

BRIEF DESCRIPTION OF THE DRAWINGS

The accompanying drawings of the embodiments will be briefly described below to illustrate the embodiments of the present invention. Obviously, the accompanying drawings in the following description are only some embodiments of the present invention, and other drawings can be obtained by those skilled in the art according to the structures shown in the accompanying drawings without any creative work.

DETAILED DESCRIPTION OF EMBODIMENTS

Figure 1:
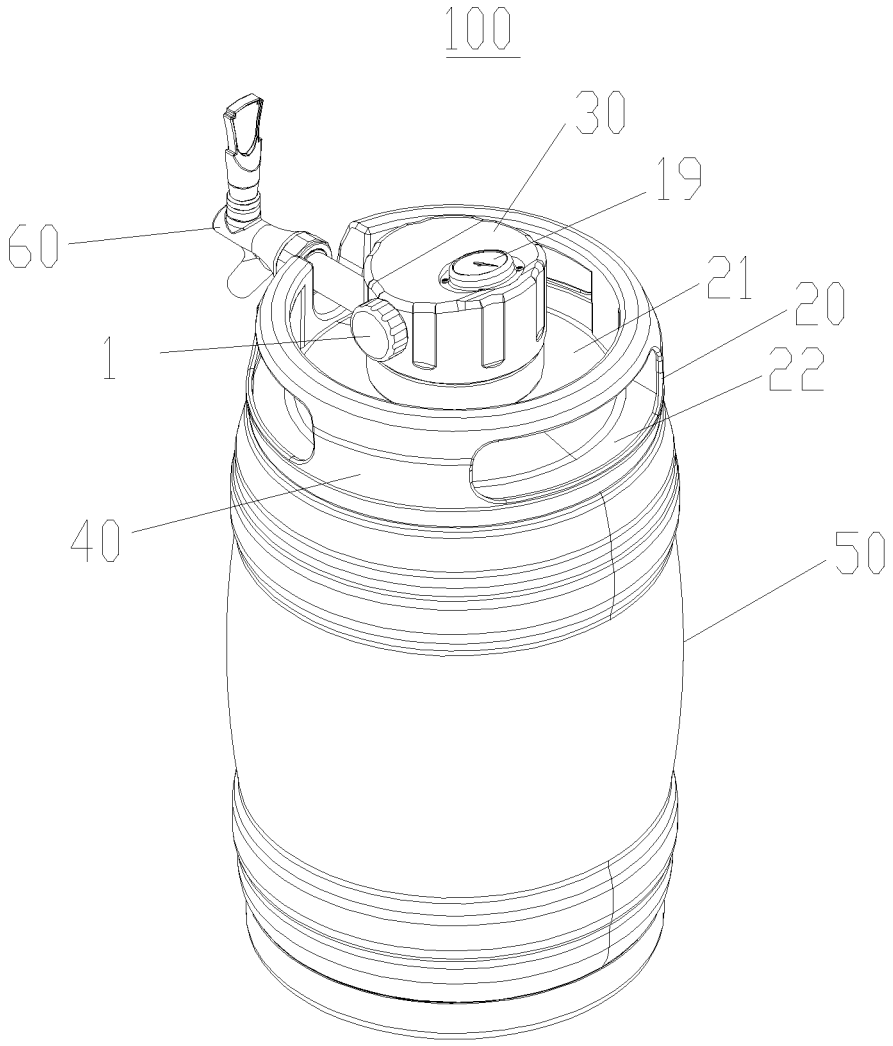
FIG. 1 is a perspective view of a liquid storage apparatus of the present invention.
Figure 2:
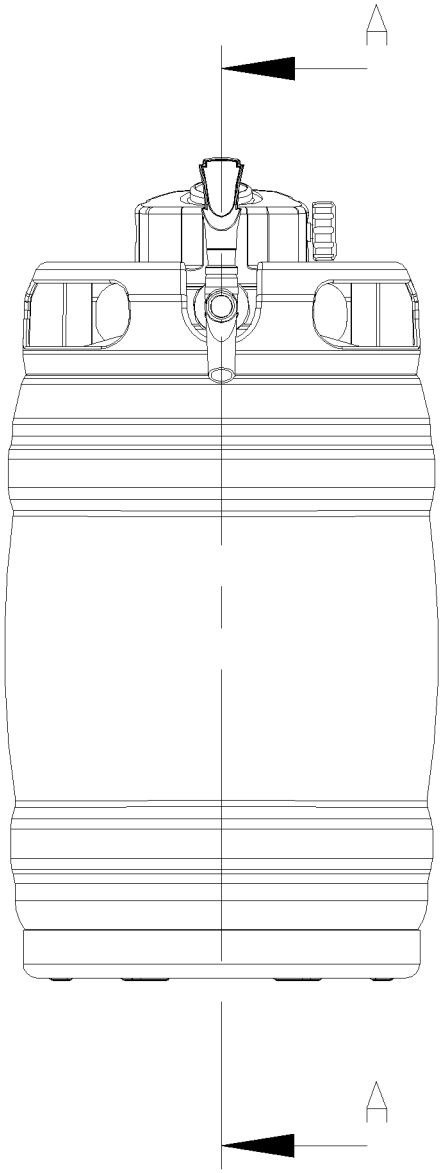
FIG. 2 is a front view of the liquid storage apparatus of the present invention.
Figure 3:
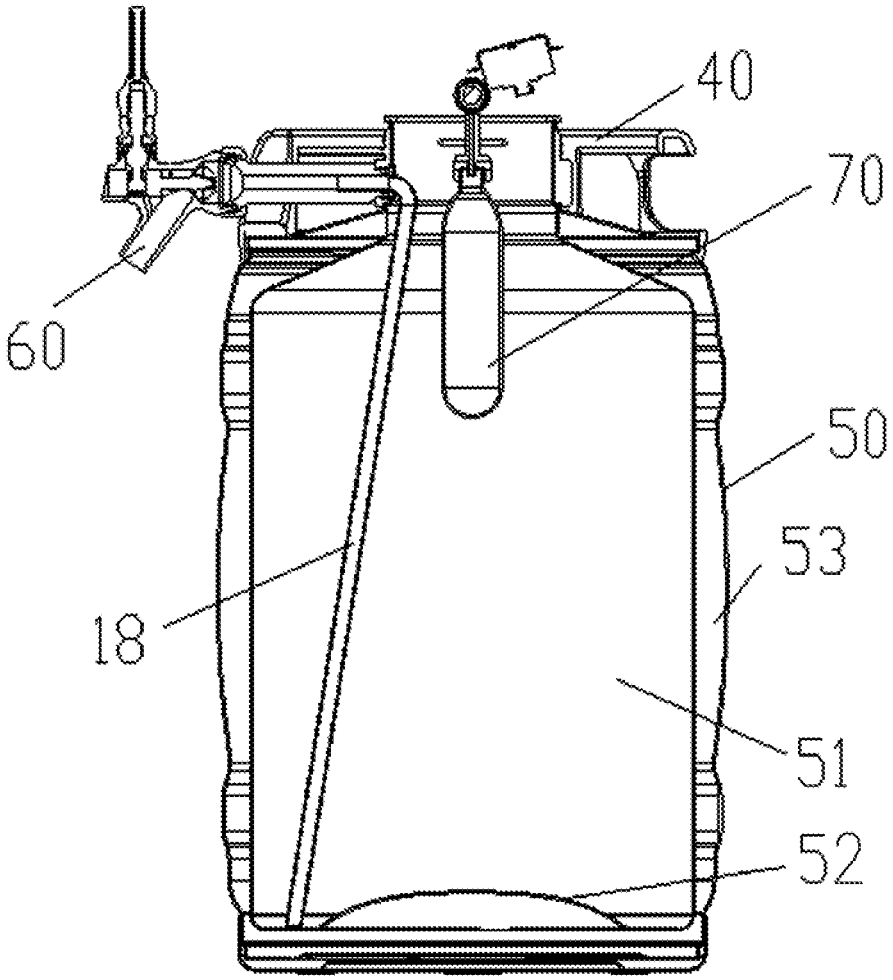
FIG. 3 is a sectional view of FIG. 2 alone A-A direction.

The technical solutions in the embodiments of the present invention will be described clearly and completely in conjunction with the accompanying drawings. It is obvious that the described embodiments are only a part of the embodiments of the present invention. All other embodiments obtained by the skilled in the art based on the embodiments of the present invention without creative efforts are within the scope of the present invention.

It should be noted that terms such as "up", "down", "left", "right", "front", "rear" in the embodiments of the present invention are only used to explain the relative position and movement, etc. of components.

In addition, terms "first", "second", and the like in the present invention are used for description only, and are not intended to indicate or imply their relative importance or the number of technical features, which explicitly or implicitly indicates that one or more features defined by "first" or "second" may be included in the present invention. In addition, the technical solutions of various embodiments may be combined to form other embodiments which are considered to fall within the claimed scope.

In the present invention, unless specified, terms "connect", "fix" and the like should be understood broadly. For example, "fix" may result in a fixed connection, a detachable connection, or an integrated configuration of elements. The elements may be connected mechanically or electrically; or directly connected or indirectly connected through an intermediate medium. Alternatively, two elements may be in communication or interact with each other unless specified. For the skilled in the art, the specific meanings of the above terms in the present invention can be understood according to specific conditions.

As shown in FIGS. 1-4, the present invention provides a liquid storage apparatus 100, comprising a container 50, an upper cover 40, a dispensing faucet 60, a gas cylinder 70 and a gas cylinder sleeve 80; and the container 50 comprises a cavity 51 and an upper opening 54.

The upper cover 40 is provided with an adjusting knob 1, and the valve of the gas cylinder 70 can be opened or closed by rotating the adjusting knob 1 to adjust the pressure of the cavity 51 of the container 50.

In some embodiments, the container 50 is of a double-wall structure and comprises a vacuum space 53 arranged between an outer wall 55 of the container and an inner wall 56 of the container. A bugle 52 is provided at a bottom of the container 50 to achieve a vacuum insulation.

Figure 4:
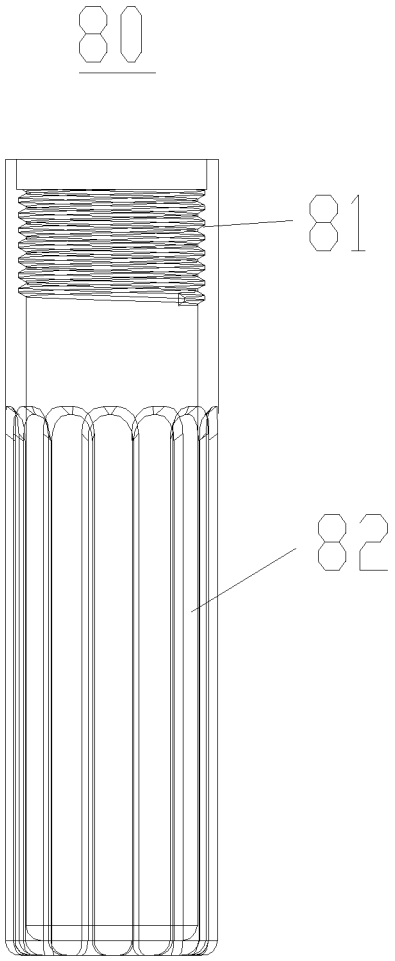
FIG. 4 is a schematic diagram showing a gas cylinder sleeve of the liquid storage apparatus of the present invention.
Figure 5:
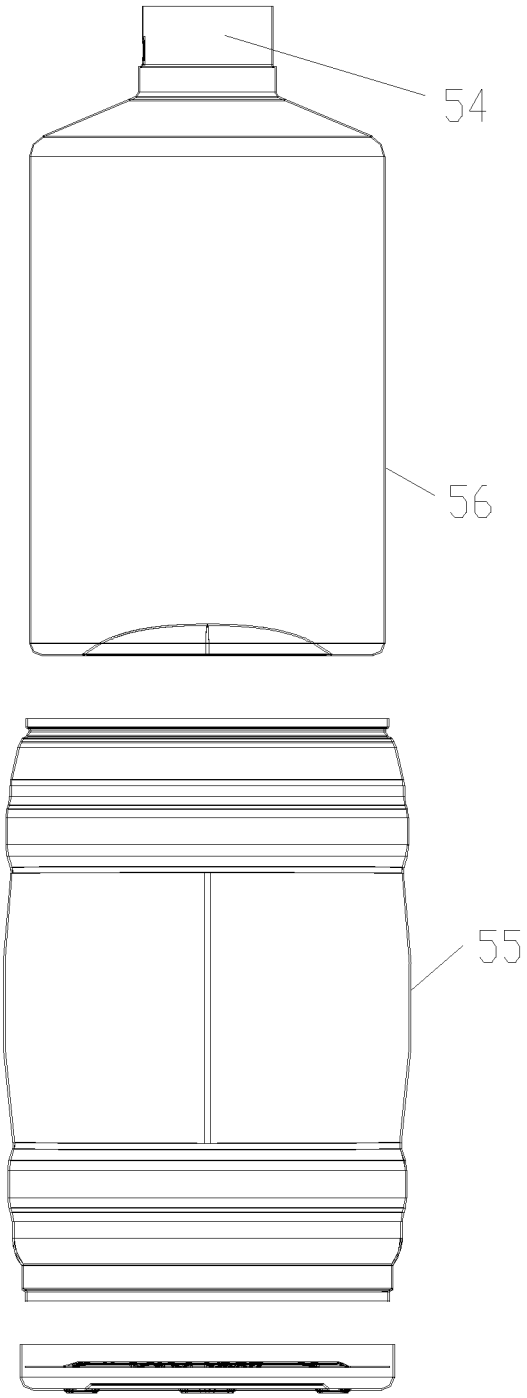
FIG. 5 is an exploded view of a container of the liquid storage apparatus of the present invention.
Figure 6:
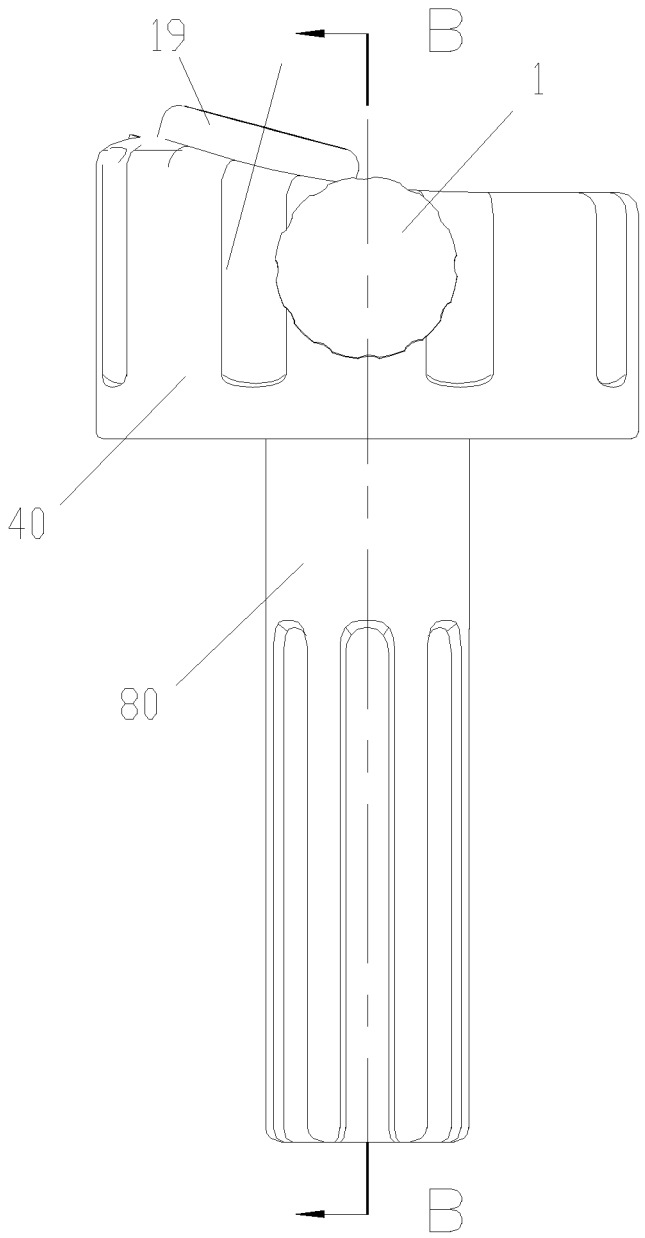
FIG. 6 is a partial schematic diagram of the liquid storage apparatus of the present invention.
Figure 7:
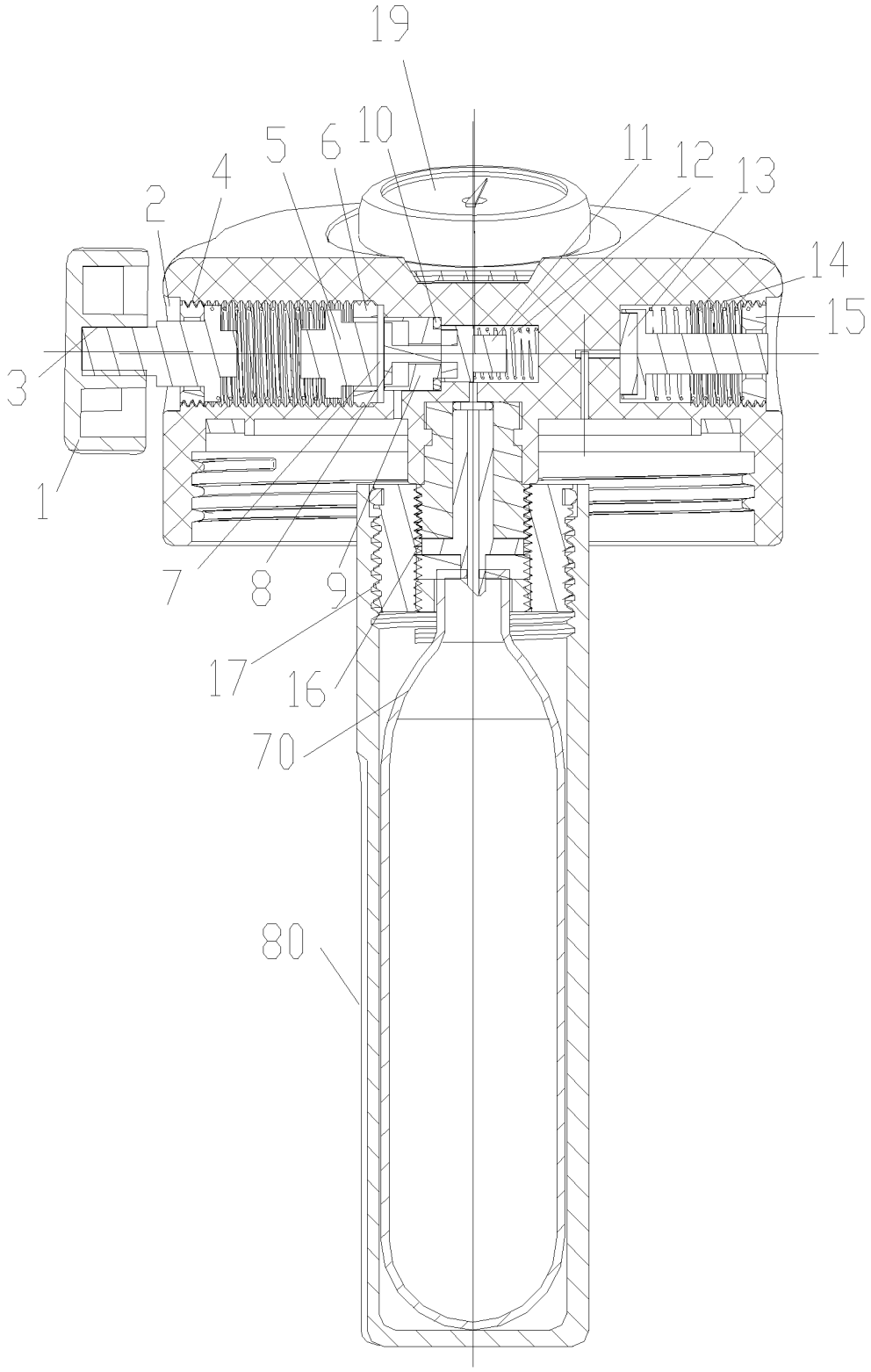
FIG. 7 is a sectional view of FIG. 6 alone B-B direction.

FIG. 5 is an exploded view of the container of the liquid storage apparatus of the present invention; FIG. 6 is a schematic view showing the assembly of the upper cover, the gas cylinder and the gas cylinder sleeve; and FIG. 7 is a cross-sectional view along B-B direction of FIG. 6. As shown in FIGS. 4-6, the gas cylinder 70 is at least partially accommodated in the gas cylinder sleeve 80. The compressed gas is stored in the gas cylinder 70. In some embodiments, the gas cylinder sleeve 80 is integrally formed and comprises an end portion 81 and a sleeve body 82. The end portion 81 is fixed to the upper cover 40, more specifically, to the connecting portion 17 of the upper cover 40; when the gas cylinder sleeve 80 is mechanically attached to the connecting portion 17 of the upper cover body 40, the sleeve body 82 extends from the upper cover 40 toward the bottom of the container; when the upper cover 40 is arranged at the container (as shown in FIG. 7), the gas cylinder 70 is further accommodated in the gas cylinder sleeve 80 which is arranged in the cavity 41 of the container 40.

The upper cover 40 is arranged at the upper opening 54 of the container 50. The dispensing faucet 60 is led out from the side of the upper cover 40 and is connected to a conduit 18 in the upper cover 40, and the conduit 18 extends to the bottom of the container 50. The adjusting knob 1 is arranged on the side of the dispensing faucet 60, enabling a more convenient use. With the conduit 18, the liquid inside the container may be discharged more completely such that the waste is avoided. In the related art, the conduit is not provided, and the liquid in the container is forced to flow into the dispensing faucet by the air pressure, where the pressure inside the container is more difficult and complicated to be adjusted. The conduit adopted by the present invention is easier to use. Specifically, the conduit 18 is a stainless steel straw which is fixed to a junction of the dispensing faucet 60 and the upper opening 54 through a clearance fit. The conduit 18 is directly clamped in a hole at the junction of the dispensing faucet 60 and the upper opening 54, and when the container has a positive pressure (i.e. $CO_2$), the liquid inside the container 50 is extracted to the dispensing faucet 60 through the conduit 18.

The upper cover 40 further comprises a pressure gauge 19 with a dial, and the pressure gauge 19 is used to indicate the pressure in the cavity.

Figure 8:
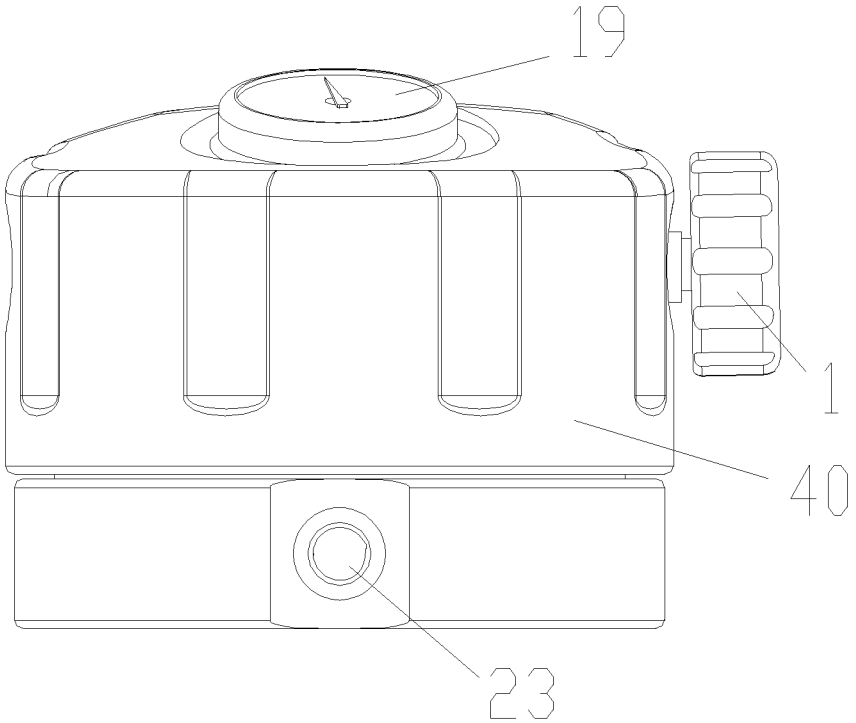
FIG. 8 is a partial schematic diagram of the liquid storage apparatus of the present invention.

As shown in FIG. 1, the upper cover 40 further comprises a housing 20 and a mounting portion 30 arranged inside the housing 20, and a recess 21 is formed between the mounting portion 30 and the housing 20. The housing 20 is annular in shape to fit with the upper opening 54 of the container 50. The housing 20 is provided with a plurality of holes 22 that are used as a handle for conveniently lifting the liquid storage apparatus 100. FIG. 8 is a partial schematic diagram of the upper cover of the liquid storage apparatus of the present invention; and as shown in FIG. 8, the housing 20 is provided with a liquid discharge hole 23 through which the conduit 18 is connected to the dispensing faucet 60.

Figure 9:
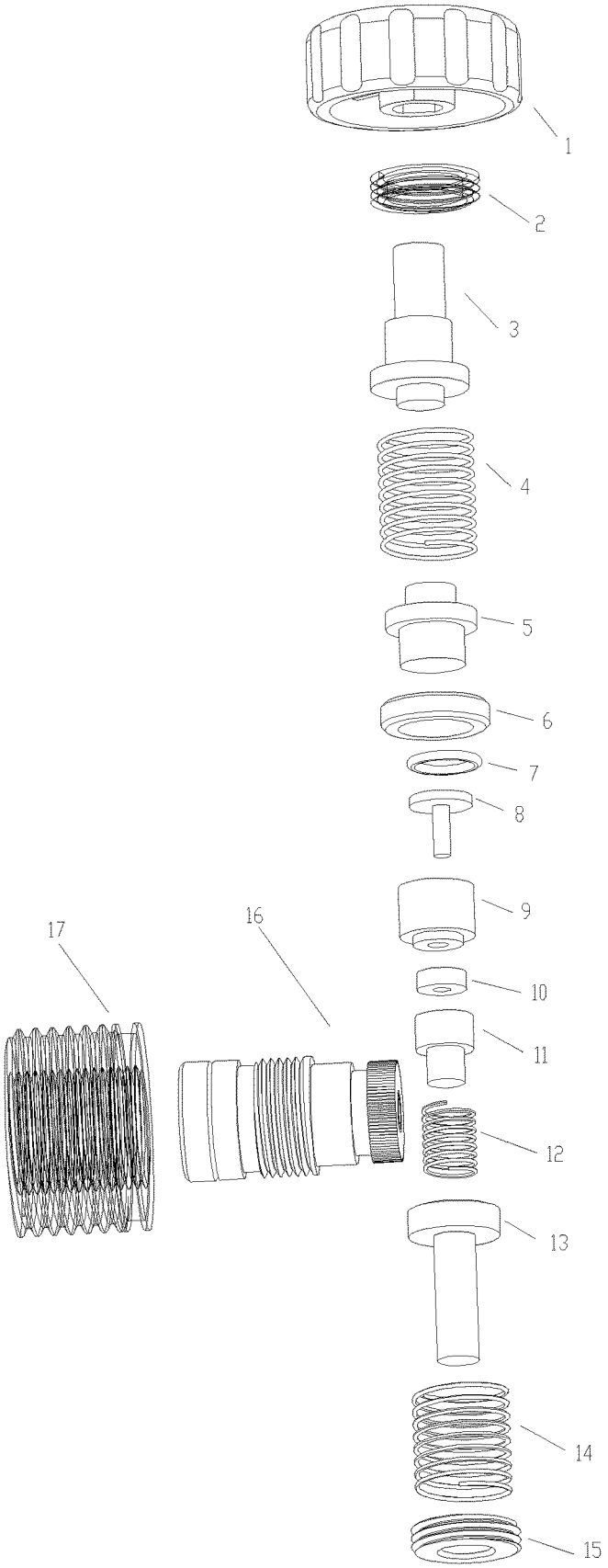
FIG. 9 is a partial exploded view of the liquid storage apparatus of the present invention.

FIG. 9 is an exploded view showing the structure of a part of the upper cover of the liquid storage apparatus. The adjustment knob 1 is arranged on the side of the mounting portion 30, and the pressure gauge 19 is fixed on the top surface of the mounting portion 30. As shown in FIG. 9, the upper cover 40 comprises a first fixing nut 2, a torsion bar 3, a first spring 4, a push block 5, a second fixing nut 6, a sealing piece 7, a push rod 8, a guiding column 9, a sealing member 10, a slider 11, a second spring 12, a valve stem 13, a third spring 14, a third fixing nut 15, a fixture 16, and a connecting portion 17.

During mounting, the torsion bar 3 is connected to the adjusting knob 1 passing through the first fixing nut 2; the first spring 4 is connected to the torsion bar 3 and the push block 5; the sealing piece 7 is arranged between the second fixing nut 6 and the push rod 8; the lower portion of the push block 5 and abuts the sealing piece 7 passing through a central hole of the second fixing nut 6; the push rod 8 passes through the guiding column 9, and the upper portion of the push rod 8 contacts the sealing piece 7 and the lower portion of the push rod 8 contacts the slider 11; the sealing member 10 is pressed into the inner groove of the slider 11 and contacts the lower portion of the guiding column 9; and the second spring 12 abuts the slider 11. The guiding column 9 is fixedly mounted in the mounting portion 30 to guide and limit the movement of the push rod 8. The side of second spring 12 away from the slider 11 fixedly abuts an inner casing of the mounting portion 30.

The valve of the gas cylinder 70 is formed by the slider 11, the sealing member 10 and the guiding column 9.

During operation, the second spring 12 acts on the slider 11 which then contacts the guiding column 9 through the sealing member 10, and the sealing member 10 deforms after contacting the slider 11, causing a sealing effect, and thus the valve is closed. Due to the threads on the first fixing nut 2 and the torsion bar 3, the torsion bar 3 moves forward by rotating the adjusting knob 1, and the first spring 4 is then compressed by the torsion bar 3. Due to the spring force, the push block 5 moves forward to press the sealing piece 7, and then the push rod 8 is forced to move forward to push the slider 11, such that the slider 11 is no longer in contact with the sealing member 10, and the valve is opened and a gas passage is formed. When the sum of the pressure in the guiding column 9 and the spring force of the second spring 12 is larger than the spring force of the first spring 4, the push block 5, the push rod 8 and the slider 11 are reset to close the valve.

The fixture 16 is embedded between the connecting portion 17 of the upper cover 40 and the mounting portion 30. The fixture 16 may break the valve to conduct gas. Specifically, the upper cover 40 is made of plastics. In cooperation with the valve stem 13, the third spring 14, and the third fixing nut 15, the fixture 16 moves to break the valve.

The connecting portion 17 is connected to the fixture 16, and the upper cover 40 is connected to the gas cylinder sleeve 80 via the connecting portion 17. Specifically, the connecting portion 17 can be set as a third fixing nut and screwed to the gas cylinder sleeve 80.

The adjustment knob 1 is used to adjust the pressure of the liquid applied to the cavity 51.

In the liquid storage apparatus 100 of the present invention, the pressure in the container 50 can be adjusted since the gas cylinder 70 is arranged in the container 50 and the valve of the gas cylinder 70 can be opened or closed by rotating the adjustment knob 1. Since the dispensing faucet 60 is led out from the side of the upper cover, the liquid can be more easily dispensed. The liquid storage apparatus 100 has the advantages of small size, integrated functions and cost saving.

The above embodiment is only a preferred embodiment of the present invention, which is not intended to limit the scope of the present invention. Any equivalent variations based on the present invention or direct or indirect application of the present invention in other related technical fields shall fall within the scope of the present invention.

I claim:

1. A liquid storage apparatus, comprising:

a container, an upper cover, a dispensing faucet, a conduit, a gas cylinder, and a gas cylinder sleeve; wherein:

the container comprises a cavity and an upper opening;

the upper cover is arranged on the upper opening; the dispensing faucet is led out from a side of the upper cover and is connected to the conduit in the upper cover; and the conduit extends to a bottom of the container;

the upper cover comprises an adjusting knob, and a pressure of the cavity of the container is adjusted by rotating the adjusting knob to open or close a valve of the gas cylinder;

the gas cylinder sleeve comprises an end portion and a sleeve body;

the end portion is fixed to the upper cover;

the upper cover further comprises a housing and a mounting portion arranged inside the housing;

the adjusting knob is arranged on a side of the mounting portion;

the upper cover further comprises a pressure gauge which is fixed to a top surface of the mounting portion; and wherein along a direction from the adjusting knob to an inside of the mounting portion, the upper cover further comprises a first fixing nut, a torsion bar, a first spring, a push block, a second fixing nut, a sealing piece, a push rod, a guiding column, a sealing member, a slider, a second spring, a valve stem, a third spring and a third fixing nut;

wherein the torsion bar is connected to the adjusting knob passing through the first fixing nut; the sealing piece is arranged between the second fixing nut and the push rod; a lower portion of the push block abuts the sealing piece passing through a central hole of the second fixing nut; the push rod passes through the guiding column, and an upper portion of the push rod contacts the sealing piece and a lower portion of the push rod contacts the slider; the sealing member is pressed into an inner groove of the slider and contacts a lower portion of the guiding column; and the second spring abuts the slider.

2. The liquid storage apparatus of claim 1, wherein the upper cover further comprises a fixture and a connecting portion; the fixture is arranged on a side of upper cover facing the cavity; the connecting portion is connected to the fixture; and the upper cover is connected to the gas cylinder via the connecting portion.

3. The liquid storage apparatus of claim 2, wherein the connecting portion is the third fixing nut and is screwed to the gas cylinder sleeve.

4. The liquid storage apparatus of claim 1, wherein a plurality of holes are provided on the housing.

* * * * *